United States Patent [19]

Chiba et al.

[11] Patent Number: 4,707,198

[45] Date of Patent: Nov. 17, 1987

[54] AMORPHOUS ALLOY AND PRODUCTION METHOD THEREOF

[75] Inventors: Kiyoshi Chiba, Chofu; Hiromitsu Ino, Machida; Kazuto Tokumitsu, Tokyo, all of Japan

[73] Assignee: Teijin Limited, Osaka, Japan

[21] Appl. No.: 876,889

[22] PCT Filed: Sep. 9, 1985

[86] PCT No.: PCT/JP85/00502

§ 371 Date: Jun. 19, 1986

§ 102(e) Date: Jun. 19, 1986

[87] PCT Pub. No.: WO86/01835

PCT Pub. Date: Mar. 27, 1986

[30] Foreign Application Priority Data

Sep. 10, 1984 [JP] Japan ..... 59-188109

[51] Int. Cl.[4] ..... H01F 1/04

[52] U.S. Cl. ..... 148/304; 148/306; 148/403; 420/84; 420/579; 420/581

[58] Field of Search ..... 148/304, 306, 403; 420/84, 579, 581

[56] References Cited

U.S. PATENT DOCUMENTS 4,282,034 8/1981 Smith et al. ..... 75/232
4,560,454 12/1985 Harris et al. ..... 148/403

FOREIGN PATENT DOCUMENTS 55-19976 5/1980 Japan .
57-211701 12/1982 Japan .

*Primary Examiner*—John P. Sheehan
*Attorney, Agent, or Firm*—Burgess, Ryan and Wayne

[57] ABSTRACT

An amorphous alloy consists of iron and tellurium and has a tellurium content of from about 14 to 90 atomic%. The amorphous alloy can be utilized as an information material for optical recording and the like, and as a magnetic material and the like. The corrosion resistance and particularly heat resistance are excellent.

4 Claims, No Drawings

AMORPHOUS ALLOY AND PRODUCTION METHOD THEREOF

1. Technical Field

The present invention is related to a novel amorphous alloy and a production method thereof, more particularly, to an amorphous alloy having a good corrosion resistance and being capable of utilization as an information-recording material, magnetic material, and the like.

2. Background Art

A disordered structure of an alloy, in which the periodicity accompanied by the crystal structure is lost, generates a certain kind of homogenity. This homogenity resides in an absence of grain boundaries, lattice defects and the like present in the crystal structure, and in a composition free of precipitates, segregations, and the like. As a result, the amorphous alloy can realize an alloy having a composition which is homogeneous and varies continuously over a broad composition range. This means that elements which cannot be mixed homogeneously in the crystal structure can provide various alloys in the case of an amorphous structure.

Note, in Japanese Unexamined Patent Publication No. 52-31703, it is disclosed that an amorphous alloy consisting of the general formula Fe (iron)-R (rare earth element), for example, Fe-Tb (terbium), allows the magnetic properties, e.g., Curie point and coercive force, to be varied by means of a continuous change of the Tb composition.

In addition, in Japanese Examined Patent Publication No. 54-15483, it is disclosed that a Te (tellurium)metalloid series-alloy containing, for example, 30 atomic % or more of Te and at least one element selected from the group consisting of In, Sn, Pb, P, As, and S, is used as a recording medium by piercing with laser light.

DISCLOSURE OF THE INVENTION

The Fe-series alloys have many phase-transformations in the crystal structure and noticeable magnetic properties, and therefore, the Fe-series alloys are useful as a number of industrial materials. On the other hand, Te has characteristics in that it is a semiconductor and exhibits an extremely small heat conductivity as compared with ordinary metals. Another characteristic of Te is that it exhibits a strong absorption of laser light having a wavelength in the neighbourhood of 800 nm, which is generally used as a light source for the writing in light recording. The characteristics of Te are conspicuous.

Notwithstanding the characteristics of Fe and Te, industrially useful, available materials in which Fe and Te are combined, are only limited Fe-Te series alloys in the following. In these alloys, Te is not solid-dissolved. They are crystallites. The compositions of these alloys include Fe Te, $FeTe_2$, and the like, and hence are sporadic. Their structure is crystal or composite-crystal exhibiting segregation and/or precipitation.

The present invention made in-depth studies of ways to provide a solid solution of a composition in which the proportion of Fe to Te continuously varies, and discovered that when the Fe composition exceeds that below which Te intrudes into the lattices of Fe, the Fe-Te alloy is rendered amorphous and a solid solution is obtained in which the Fe and Te composition continuously varies.

Accordingly, a specified invention according to the present invention resides in a novel amorphous alloy having an excellent corrosion resistance and consisting of Fe-Te with a Te content of from 14 to 90 atomic %. The second invention resides in a method of production of the novel amorphous alloy.

The novel alloy according to the present invention is expressed by the general formula $Fe_{100-x}Te_x$ (herein, x is atomic %) and has an amorphous structure. When Te is successively added to polycrystals of Fe by a trace amount, Te intrudes into the Fe lattices which thus undergo strain.

The following structural changes depending upon the Te content were recognized. That is, when x is less than approximately 7%, an $\alpha$-Fe (Te) solid solution is formed. When x exceeds approximately 7%, the structure is transferred to a transitional region, in which an amorphous structure is dispersed in the crystalline structure. In a composition having an x of 12%, the lattice strain is conspicuous. The existence of the strained crystal state is verified by the $\gamma$-ray resonance absorption method (Mössbauer spectroscopy method) which detects change in the magnetic properties and which is sensitively responsive to the lattice strain. The above mentioned transional region seems to be present up to approximately 12% of x. On the other hand, in the composition where x=14%, a conspicuous disorder in the magnetic order of ferromagnetism due to Fe is observed by a Mössbauer spectrum.

Taking into consideration the Mössbauer spectrum and the result of the X-ray diffraction method, which is well known for confirming the crystal state, with one another, the existence of an amorphous structure was confirmed.

In the transitional region, in which the crystal is transferred to the amorphous state in accordance with the change in Te composition, the lattice strain gradually increases with the increase in Te composition. The amorphous formation is delicately influenced by a slight variation in conditions for forming an alloy, even if composition is identical. Because of the gradual increase in the lattice strain and the delicate influence of the forming conditions of an alloy, the limit of composition where the amorphous body is formed is not necessarily clarified. It is, however, understood from the foregoing descriptions that in a composition having an x of 14% or more, an amorphous alloy of Fe-Te is obtained.

It was confirmed that an x exceeding 90% also corresponds to the transitional region. It was also confirmed that the amorphous alloy having an x of from 14 to 90% has an excellent corrosion resistance and useful properties described hereinafter. The Fe-Te alloy maintains an amorphous structure and metallic properties, especially electric conductivity, and is not virtually different from that of Fe, at the Te composition of from x=14 atomic % upto x=60 atomic %. The electric conductivity slightly lessens but the electric conductivity is excellent, when x is further increased to 90%. When x exceeds 90%, alloy lies in the above mentioned transitional region and becomes semiconductive based on Te. As described above, the amorphous alloy according to the present invention exhibits an electric conductivity which is useful as a measure against static electricity when applied for information-recording materials.

On the other hand, regarding the magnetic properties, the ferromagnetic property at the neighbourhood of x=14% gradually is transferred with the increase in x, to a state under which the magnetic moment is dispressed in the amorphous alloy. In addition, regarding the optical properties, these move from that inherent in metals to that inherent in Te with the increase in the Te composition, with the result that a photosensitive property to, for example, a semiconductor laser-light having a wave length of 800 nm, is enhanced. Accordingly the amorphous alloy according to the present invention is useful for materials for recording information by magnetism, optomagnetism, light, or the like.

It was confirmed that, at an x of from 14 to 50%, the amorphous structure is stable even when heat-treated at 200° C., for 30 minutes in vacuum. The Fe-Te amorphous alloy according to the present invention, therefore, has a stable heat resistance.

From the foregoing, in the Fe-Te amorphous alloy according to the present invention, the Te content is 14~90 atomic %, preferably the Te content is 60 atomic % or less in the light of metallic properties, especially the electrical conductivity, and is 50 atomic % or less in the light of heat resistance. Preferably the Te content is from 70 to 85% in the light of a light sensitive property to semiconductor laser.

The amorphous alloy according to the present invention may slightly contain other elements such as Mo, Ti, Mn, W, Zr, Hf and Cu contained, for example, in the raw materials of Fe, provided that the amorphous properties are not degraded.

The amorphous alloy consisting of Fe-Te according to the present invention is prepared by a method having a speed at least equal to the critical cooling speed, at which the structure of constituting elements of an alloy is frozen prior to their rearrangement to crystal. The most frequently used such methods are the gun method, the piston anvil method and the rotary roll method. In the rotary roll method, molten liquid is spread at a high speed on a metal plate to form a thin film and is rapidly cooled to obtain an amorphous alloy sheet. It is, however, difficult by means of these methods to vitrify the alloy consisting of Fe-Te, because Te has a melting point greatly different from that of Fe and a low viscosity. The amorphous alloy according to the present invention is prepared preferably by methods in which solidification from a gas phase occurs, that is, physical deposition methods, such as the vacuum deposition methods and the sputtering methods. In the vacuum deposition methods, multi-sources vaporization methods, methods for heating the alloy sample by an electron beam, a high frequency induction heating, and resistance heating, and a flash vaporization method, and combinations thereof, can be used. The multi-sources vaporization method, however, involves problems in that a plurality of sources are necessary for vaporization, and further the difference in the vapor pressure of the alloy components is so great as to incur decomposition of a sample. The sputtering method is particularly preferred for realizing and preparing the amorphous alloy consisting of Fe-Te. In the sputtering method, bipolar or magnetron system with direct current or at RF, the opposed-targets system, and ion-beam system are used. The alloy consisting of Fe and Te or atom clusters of binary alloy rendered to a gaseous state by means of a plurality of targets, composite targets or the like deposit on a substrate while undergoing a rapid cooling process. The sputtering method enables to prepare the Fe-Te amorphous alloy, when its composition falls within the above described composition range. A base, on which the solidification from gas phase occurs, may be metal, glass, ceramics, plastics, and the like, and are not specifically limited. The sputtering method allows a continuous formation with the use of a plastic substrate, the heat resistance of which is low and is, therefore, particularly advantageous for its application to the formation of information-recording materials.

The present invention is hereinafter specifically described with reference to, but is not limited by, the following examples. In the examples, the composition is described by atomic %.

(EXAMPLE 1)

In a radio frequency-, bipolar sputtering device, was disposed an Fe target having a 99.9% purity and diameter of 6 mm, and a composite target in which ninety spherical Te balls having a 99.9% purity and a diameter of approximately 1 mm were dispersedly located. A 125 μm thick polyimide film was attached on the water-cooled holder of a substrate, separated from the surface of targets by approximately 4 cm. The vacuum chamber was evacuated to $2.7\times10^{-5}$ Pa and then 99.999 vol % Ar was introduced in the chamber to obtain 2.7 Pa. The sputtering was carried out at a power of 100 W. The sputtering speed was approximately 1 Å/sec. A 5,700 Å thick alloy film was obtained after 100 minutes. The composition of an alloy film was $Fe_{85.5}Te_{14.5}$. The diffraction peaks by the X-ray diffraction measurement were completely broad and indicated an amorphous state. Accordingly, the desired Fe-Te amorphous alloy was obtained.

(EXAMPLES 2-7, COMPARATIVE EXAMPLES 1-6)

Alloy films having different compositions were obtained under the same conditions as in Example 1 except that a number of Te balls on a target and a dispersion state of the Te balls was varied. The alloy films were each subjected to X-ray diffraction measurement. The results are shown in Table 1. The materials produced in Examples 2 through 7 were homogeneous Fe-Te amorphous alloys.

TABLE 1

| Sample Nos. | Composition (atomic %) | X-ray diffraction analysis |
|---|---|---|
| Example | | |
| 2 | $Fe_{84}Te_{16}$ | Amorphous |
| 3 | $Fe_{76}Te_{24}$ | " |
| 4 | $Fe_{69}Te_{31}$ | " |
| 5 | $Fe_{58}Te_{42}$ | " |
| 6 | $Fe_{46}Te_{54}$ | " |
| 7 | $Fe_{13}Te_{87}$ | " |
| Comparative | | |
| 1 | $Fe_{99}Te_{1}$ | Crystalline |
| 2 | $Fe_{96}Te_{4}$ | " |
| 3 | $Fe_{94}Te_{6}$ | " |
| 4 | $Fe_{91}Te_{9}$ | Crystalline, partly amorphous mixed |
| 5 | $Fe_{89}Te_{11}$ | Crystalline, partly amorphous mixed |
| 6 | $Fe_{88}Te_{12}$ | Crystalline, partly amorphous mixed |
| 7 | $Fe_{9}Te_{91}$ | Crystalline, partly amorphous mixed |

(EXAMPLES 8-11, COMPARATIVE EXAMPLES 7-10)

A 1.5 mm thick glass plate was attached on the holder of a substrate of a direct-current magnetron sputtering apparatus. A plurality of 5 mm square and 1 mm thick Te plates having a purity of 99.99% were dispersedly located on the Fe target having a purity of 99.9% and a diameter of 12 cm. The sputtering was carried out in an Ar atmosphere of 4 Pa and at a power of 200 W. The sputtering speed was approximately 10 Å/sec and the alloy film thickness was approximately 2000 Å. The alloy films obtained were subjected to X-ray diffraction analysis and then dipped in a 2N $HNO_3$ solution. After dipping for 5 minutes at normal temperature, the alloy films were observed. The results are shown in Table 2. In the table, x denotes a complete solution, Δ denotes peel, o denotes a slight change, and ◎ denotes no change. As is shown in the examples, the amorphous alloy according to the present invention exhibited excellent corrosion resistance.

TABLE 2

| Sample Nos. | Composition (atomic %) | X-ray diffraction analysis | Corrosion resistance |
|---|---|---|---|
| Example | | | |
| 8 | $Fe_{82}Te_{18}$ | Amorphous | ◎ |
| 9 | $Fe_{73}Te_{27}$ | " | ◎ |
| 10 | $Fe_{51}Te_{49}$ | " | |
| 11 | $Fe_{39}Te_{61}$ | " | |
| Comparative | | | |
| 7 | Fe | Crystalline | x |
| 8 | $Fe_{96}Te_4$ | " | x |
| 9 | $Fe_{93}Te_7$ | " | x |
| 10 | $Fe_{89}Te_{11}$ | Crystalline, partly amorphous mixed | Δ |

(EXAMPLE 12)

In the vaporization source consisting of two resistance-heating type alumina crucibles of a vacuum deposition apparatus, Fe having a purity of 99.9% and Te having a purity of 99.99% were loaded. The vacuum chamber was evacuated to $2.7\times10^{-3}$ Pa. The vaporization speed of Fe and Te was controlled by two independent power sources. An alloy film was formed on a 1.2 mm thick polymethylmethacrylate substrate separated from the vaporization source by 20 cm. The film obtained at the vaporization speed of approximately 15 Å/sec had a composition of $Fe_{56}Te_{44}$ and a thickness of 170 Å. The X-ray diffraction revealed the alloy film to be amorphous. This alloy film was irradiated by a light pulse of 10 mW and 500 ns of a semiconductor laser having a spot diameter of 12 μm and a wavelength of 820 nm. The reflectivity then changed by approximately 4% while leaving the film.

(EXAMPLE 13~16)

The samples obtained in Examples 8 through 11 were heat treated at 200° C. for 30 minutes in vacuum, to evaluate the heat resistance of the amorphous structure. The results are shown in Table 3.

TABLE 3

| Sample Nos. | Composition (atomic %) | X-ray diffraction analysis: Before heat treatment | X-ray diffraction analysis: After heat treatment |
|---|---|---|---|
| Example | | | |
| 13 | $Fe_{82}Te_{18}$ | Amorphous | Amorphous |
| 14 | $Fe_{73}Te_{27}$ | " | " |
| 15 | $Fe_{51}Te_{49}$ | " | " |
| 16 | $Fe_{39}Te_{61}$ | " | Crystalline, partly amorphous mixed |

(EXAMPLE 17, 18)

A 1.2 mm thick polycarbonate substrate was attached on the holder of substrate of a radio frequency-, bipolar magnetron sputtering apparatus. A plurality of 5 mm square and 1 mm thick Te plates having a purity of 99.99% were distributed on an Fe target having a purity of 99.9% and a diameter of 6 cm. The sputtering was carried out in an Ar atmosphere of 4 Pa and at a power of 100 W, so that the alloy films having a composition of $Fe_{29}Te_{71}$ (Example 17) and $Fe_{15}Te_{85}$ (Example 18) were obtained. The sputtering speed was 2 Å/sec and the film thickness was 1000 Å. The X-ray diffraction measurement revealed a broad diffraction peak which indicated an amorphous state.

The alloy films were irradiated from the side of substrate with a light pulse of 9 mW and 1 μs of a semiconductor laser having a spot diameter of 1.2 μm and a wave length of 820 nm. The reflectivity of the alloy films to the light having a wavelength of 820 nm changed from 43% to 31%, i.e., by 12%, for the case of $Fe_{29}Te_{71}$ and from 41% to 37%, i.e., by 4%, for the case of $Fe_{15}Te_{85}$. The same portions of the alloy films were further irradiated with a light pulse of 9 mW and 500 ns, and the reflectivity then reverted to the original values.

Accordingly, it was confirmed that the Fe-Te amorphous alloy film had a reversibility property for light-writing and erasing.

(Industrial Applicability)

As is described hereinabove, the amorphous alloy consisting of Fe-Te according to the present invention is distinguished, by a uniform alloy over a continuous composition, from the crystal alloy which has heterogenities exhibiting sporadic composition, such as grain boundaries, precipitates, segregations, and the like. As described above, the Fe-Te amorphous alloy according to the present invention exhibits industrially superior and excellent properties at an appropriate composition, for example, as follows. An alloy having excellent corrosion resistance is obtained by the addition of Te to Fe. In a specific range, an amorphous alloy having an improved heat-resistance is obtained. Depending upon an alloy composition, the material obtained exhibits the transformation of magnetic properties from ferromagnetism to paramagnetism. In addition, the material obtained by the Te addition, has an electric property which lies in an intermediate region between the metallic and semiconductive. Furthermore, the Fe alloy material having good optical sensitivity to semiconductor laser light, important for optical recording, and being applicable to reversible recording, is obtained.

The applications and use of the amorphous alloy of Fe-Te according to the present invention are not limited to those described above but may be those, in which the above described properties are utilized in combination. In addition, the alloy is used in the application in which an external energy, such as heat and light, are imparted thereto as to partially or totally crystallize the alloy, and further, the changes in the physical and/or chemical properties are utilized. This utilization is also useful for the high density informationrecording materials, in which the above-described absorption of laser light is utilized.

We claim:

1. An amorphous alloy consisting of iron and tellurium and having a tellurium content of from about 14 to 90 atomic %.

2. An amorphous alloy according to claim 1 having a tellurium content of from about 14 to 60 atomic %.

3. An amorphous alloy according to claim 2, having a tellurium content of from about 14 to 50 atomic %.

4. An amorphous alloy according to claim 1, having a tellurium content of from about 70 to 85 atomic %.

* * * * *